US007182480B2

(12) United States Patent
Kan

(10) Patent No.: US 7,182,480 B2
(45) Date of Patent: Feb. 27, 2007

(54) SYSTEM AND METHOD FOR MANIPULATING ILLUMINATION CREATED BY AN ARRAY OF LIGHT EMITTING DEVICES

(75) Inventor: Peter Kan, North Vancouver (CA)

(73) Assignee: TIR Systems Ltd., Burnaby (CA)

( * ) Notice: Subject to any disclaimer, the term of this patent is extended or adjusted under 35 U.S.C. 154(b) by 98 days.

(21) Appl. No.: 10/730,816

(22) Filed: Dec. 8, 2003

(65) Prior Publication Data

US 2004/0174706 A1 Sep. 9, 2004

(30) Foreign Application Priority Data

Mar. 5, 2003 (CA) ..... 2420939

(51) Int. Cl.
*F21V 13/00* (2006.01)

(52) U.S. Cl. ..... 362/242; 362/227; 362/240; 362/241; 362/243; 362/245; 362/246; 362/307; 362/343

(58) Field of Classification Search ..... 362/240–243, 362/245, 246, 307, 343, 227
See application file for complete search history.

(56) References Cited

U.S. PATENT DOCUMENTS

| | | | | |
|---|---|---|---|---|
| 4,964,025 | A | 10/1990 | Smith | 362/346 |
| 5,660,461 | A | 8/1997 | Ignatius et al. | 362/241 |
| 6,102,552 | A | 8/2000 | Tullis | 362/249 |
| 6,200,002 | B1 | 3/2001 | Marshall et al. | 362/231 |
| 6,222,623 | B1 | 4/2001 | Wetherell | 356/236 |
| 6,234,643 | B1 * | 5/2001 | Lichon, Jr. | 362/147 |
| 6,234,645 | B1 | 5/2001 | Börner et al. | 362/231 |
| 6,241,363 | B1 | 6/2001 | Lee | 362/231 |
| 6,260,981 | B1 * | 7/2001 | Fiene | 362/147 |
| 6,264,346 | B1 | 7/2001 | Pashley et al. | 362/244 |
| 6,361,191 | B1 * | 3/2002 | Simon | 362/328 |
| 6,439,736 | B1 | 8/2002 | Fiene | 362/147 |
| 6,447,133 | B1 | 9/2002 | Eschke et al. | 362/31 |
| 6,814,470 | B2 * | 11/2004 | Rizkin et al. | 362/327 |
| 2003/0095407 | A1 * | 5/2003 | Yao | 362/241 |

OTHER PUBLICATIONS

Welford, W.T. and Winston, F., *High Collection Nonimaging Optics*, San Diego: Academic Press, 1989.

* cited by examiner

*Primary Examiner*—Stephen F Husar
*Assistant Examiner*—Meghan K. Dunwiddie
(74) *Attorney, Agent, or Firm*—DLA Piper US LLP

(57) ABSTRACT

The present invention provides an illumination optical system that enables the direction and mixing of light from light emitting devices. The optical system comprises a plurality of light emitting devices that are spatially arranged in an array, wherein this array comprises one or more sections, such that the light emitting devices in a particular section emit light within a predetermined wavelength range. Through the use of a combination of macroscopic and microscopic optical systems, the illumination created by the array can be manipulated such that a desired illumination distribution is created. The macroscopic optical system provides a means for redirecting the illumination in one or more desired directions, wherein this redirection is provided by a collection of appropriately shaped and positioned reflective optics. Subsequent to its interaction with the macroscopic optical system, the illumination is manipulated by a microscopic optical system that enables the diffusion of the illumination in a predetermined manner, while retaining the desired angular distribution of the illumination created by the macroscopic optical system. Through the appropriate design and orientation of both the macroscopic and microscopic optical systems, a desired illumination effect can be created.

19 Claims, 10 Drawing Sheets

SYSTEM AND METHOD FOR MANIPULATING ILLUMINATION CREATED BY AN ARRAY OF LIGHT EMITTING DEVICES

CROSS REFERENCE TO RELATED APPLICATION

This application claims the benefit of priority under 35 U.S.C. § 119(a) of Canadian Application No. 2,420,939 filed Mar. 5, 2003, the entire content of which is incorporated herein by reference.

BACKGROUND OF THE INVENTION

1. Field of the Invention

The present invention pertains to the field of optical systems and in particular to an optical system incorporating solid-state light emitting devices configured in an array.

2. Background Information

Recent innovations in LED design and manufacturing have led to the introduction of high-brightness LEDs that produce sufficient luminous flux for architectural and entertainment lighting applications. LEDs with different wavelength ranges, for example, red, green, and blue, have been combined in arrays with ancillary refractive optics to generate user-specified colours. An example of this type of configuration is the Space Cannon Metamorphosis™ (Space Cannon vH, Fubine, Italy), wherein an array of red, green, and blue LEDs with individual moulded plastic optics, produces a narrow beam of coloured or white light. An example of a device that can produce a broad "wash" of coloured or white light is the Color Kinetics ColorBlast™ 12 (Color Kinetics, Boston Mass.), which provides an array of red, green, and blue LEDs 20 mounted behind a frosted or clear tempered glass panel 40, as illustrated in FIG. 1.

The object of these light fixtures is to provide a narrow or broad distribution of light that has a uniform colour. However, the arrays of LEDs associated with these particular products consist of clusters of individual red, green, and blue LEDs that are provided in order to enable the satisfactory blending of the individually produced colours, thereby producing a user-specified colour on the illuminated surfaces. If, however, the LEDs are arranged in linear rows of separate colours, the projected beam of light typically exhibits objectionable colour gradients at its edges. In addition, surfaces being illuminated using the above mentioned devices, that have occluding objects thereon, results in strong colour banding being visible on the illuminated surface due to the shadow cast by this occluding object.

In addition, the above devices can include moulded plastic optics 30, as illustrated in FIG. 2, associated with each of the LEDs 20 to provide the control of the illumination. However these types of optics are bulky and relatively expensive to manufacture. Furthermore, these forms of refractive optics are unable to preferentially redirect emitted illumination in an off-axis direction, with respect to the plane of the array of LEDs, however this is possible if the LEDs are mounted at an angle with respect to the plane of the array. In order to enable this type of mounting, each LED could be mounted and wired separately to enable this form or orientation, however this would preclude the use of a common circuit board for the mounting of the LEDs, as is a current standard, thereby resulting in a more costly device.

A further disadvantage of the prior art is that red, green and blue LEDs typically require different drive voltages and can produce ranging colours of light, as such binning of LEDs is typically performed, in order to ensure a uniform illumination colour being produced by an array of LEDs. As such, LED manufacturers typically offer pre-assembled linear arrays of single colour LEDs with matched colours. For example, the Lumileds Line of products (Lumileds Lighting LLC, San Jose Calif.) comprise twelve high-brightness LEDs mounted in a row on a common printed circuit board. As has been previously mentioned, linear arrays of LEDs are difficult to incorporate into current lighting devices due to the problems of colour gradients and colour banding.

The prior art comprises a number documents that define the design and method of use of reflector arrays. For example, U.S. Pat. Nos. 6,260,981 and 6,439,736 both define a luminaire designed to be suitable for suspended ceilings, wherein the design of this luminaire enables an improved packing density of these products during shipping. The reflector is designed having a grid pattern with a tapered design that allows these reflectors to be stored and transported such that one reflector nested within another thereby conserving space.

U.S. Pat. No. 6,234,643 provides a lighting fixture for reducing glare and dark spots on ceilings and walls through the use of direct and indirect reflectors. This lighting fixture includes first and second sets of elongated, parallel, spaced apart reflectors that intersect at a ninety-degree angle thereby forming an open reflector grid. In addition, the lighting fixture includes a plurality of indirect reflectors connected to the outside walls of the open reflector grid which provide a means for reducing glare and dark spots on the ceiling and walls, which can be caused by the plurality of fluorescent lamps in the louver housing. This lighting fixture is designed specifically for use with fluorescent lamps and as such does not provide a means for manipulating the illumination provided by a plurality of discrete light sources that produce different wavelengths of illumination.

In addition, the design and method of making an array of optoelectronic devices is provided in U.S. Pat. No. 5,660,461. The array of LED is formed from a plurality of modular units, wherein a modular unit comprises a light emitting diode and a moulded reflector unit that has a cone shape. In order to assemble the array of optoelectronic devices, a plurality of the modular units are interconnected by a mechanical snap type connection. As such the modular units are fabricated individually and the use of a plurality of LEDs on a linear printed circuit board, as is common practice in the art, would not be applicable for this type of design.

The prior art further comprises a number of documents that disclose diffusers that are used for blending or distributing illumination in a plurality of directions. For example, U.S. Pat. No. 6,447,133 provides an illumination member having a diffuser that has therein a plurality of spheres or particles that have a different refractive index when compared to the diffuser material itself. As such, the illumination on the output face of the diffuser can be controlled by varying the number, size and homogeneity of these spheres or particles. Specifically, this diffuser has been designed such that is can be a few millimetres thick and have the ability to emit a homogeneously distributed luminance on its output face. This type of diffuser is specifically designed for use with a LCD display and provides a means for controlling the illumination there from. However this diffuser has not been designed to provide the blending of colours produced by a plurality of discrete light sources in close proximity.

U.S. Pat. No. 6,241,363 provides a coloured light mixing device that can be associated with at least one light source set, such that the light source set has three light generating units that generate light of different colours. The coloured light mixing device comprises a colour mixing plate that is made of transparent material and has a lower surface that has a lower wavelike pattern thereon that faces the light source set, and an opposite upper surface that has an upper wavelike pattern thereon. In addition, the upper wavelike pattern is oriented differently from the lower wavelike pattern. Upon being hit by light from the light source set, the lower wavelike pattern acts as a plurality of linear light sources for mixing light colours inside the colour mixing plate and the upper wavelike pattern thereby emits light of uniform intensity and mixed hue. This design of a diffuser enables colour mixing specifically designed for the situation where there is close proximity between the various colours of light and therefore may not be effective in blending illumination produced by a first strip of light emitting devices producing a first colour that is flanked by a second strip producing a different illumination colour.

Finally, U.S. Pat. No. 6,264,346 provides an apparatus for mixing light from different coloured LEDs. This apparatus comprises a faceted diffusive layer that is used to mix light from an LED array and is more specifically designed for the creation of white light from these different coloured LEDs. This type of apparatus essentially directs all of the illumination from the multiple different coloured light emitting diodes in the same direction thereby combining them to form the desired illumination colour, namely white light.

Therefore there is a need for a new method and apparatus for the manipulation of illumination created by an array of light emitting devices that is capable of reducing colour gradients and colour banding in addition to being optically efficient and capable of illumination distribution in an off-axis direction of the light emitting device array, while being applicable for use with strips of single coloured light emitting devices, as are commonly produced in the industry.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a system and method for manipulating illumination created by an array of light emitting devices. In accordance with an aspect of the present invention, there is provided a system for manipulating illumination created by an array of light emitting devices, said system comprising: a plurality of light emitting devices spatially arranged in an array, said array separated into one or more sections, wherein each section of the array includes light emitting devices capable of creating illumination having a predetermined wavelength range; a macroscopic optical system adjacent to the plurality of light emitting devices, said macroscopic optical system enabling redirection of the illumination created by the plurality of light emitting devices; and a microscopic optical system for diffusing the illumination created by the plurality of light emitting devices subsequent to the redirection by the macroscopic optical system, thereby providing a desired level of blending of the predetermined wavelengths ranges.

In accordance with another aspect of the invention, there is provided a method for manipulating illumination created by an array of light emitting devices, said method comprising the steps of: redirecting the illumination using reflective optics formed in a grid pattern; diffusing the redirected illumination thereby blending the redirected illumination to create a desired illumination effect, said diffusing retaining a desired angular distribution of the illumination created by the reflective optics.

DETAILED DESCRIPTION OF THE INVENTION

Definitions

Figure 1:
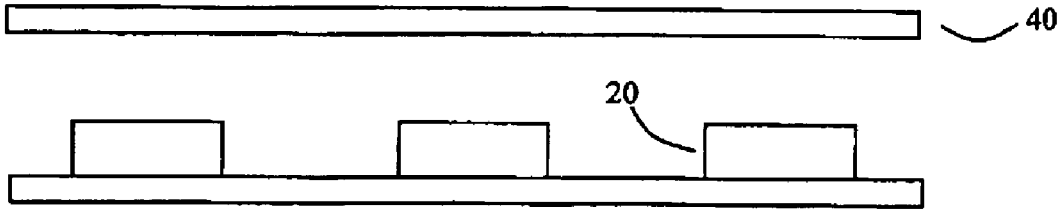
FIGURE 1 (Prior Art)
FIG. 1 illustrates a prior art configuration wherein illumination from a light emitting diode is manipulated by a diffuser panel.
Figure 2:
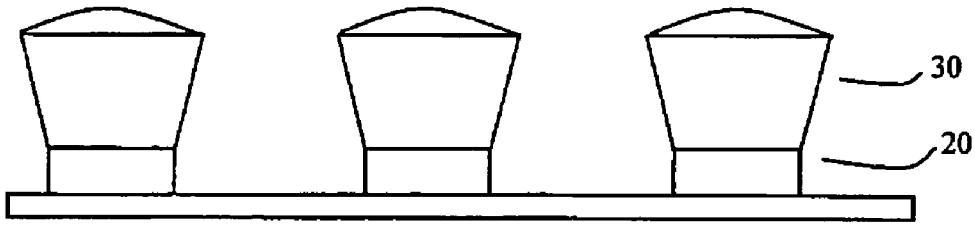
FIGURE 2 (Prior Art)
FIG. 2 illustrates another prior art configuration wherein illumination created by a light emitting diode is manipulated by a moulded refractive optic.

The term "light emitting device" or "LED" are used interchangeably to define any form of solid-state light device enabling the creation of illumination or irradiation, which includes infrared radiation, visible light, and ultraviolet radiation.

The term "array" is used to define a geometric layout defining the placement and arrangement of light emitting devices. This geometric layout can be one dimensional, for example linear, or two dimensional, for example planar.

Unless defined otherwise, all technical and scientific terms used herein have the same meaning as commonly understood by one of ordinary skill in the art to which this invention belongs.

The present invention provides an illumination optical system that enables the direction and mixing of light from light emitting devices. The optical system comprises a plurality of light emitting devices that are spatially arranged in an array, wherein this array comprises one or more sections, such that the light emitting devices in a particular section emit light within a predetermined wavelength range. Through the use of a combination of macroscopic and microscopic optical systems, the illumination created by the array can be manipulated such that a desired illumination distribution is created. The macroscopic optical system provides a means for redirecting the illumination in one or more desired directions, wherein this redirection is provided by a collection of appropriately shaped and positioned reflective optics. Subsequent to its interaction with the macroscopic optical system, the illumination is manipulated by a microscopic optical system that enables the diffusion of the illumination in a predetermined manner, while retaining the desired angular distribution of the illumination created by the macroscopic optical system. Through the appropriate design and orientation of both the macroscopic and microscopic optical systems, a desired illumination effect can be created.

Macroscopic Optical System

The macroscopic optical system provides a means for redirecting the illumination created by the point source light emitting devices in one or more desired directions. This redirection of the illumination is enabled by a collection of appropriately shaped and positioned reflective optics that can preferentially and efficiently redirect light from the light emitting diodes with a greater level of efficiency when compared to the use of moulded refractive optics.

The macroscopic optical system is typically designed having reference to a grid or orthogonal type pattern and as such, depending on the design of the macroscopic optical system, the reflective optics can be oriented in one or both of these orthogonal directions. Depending on the design of the reflective optics, the illumination created by the light emitting devices can be redirected in a variety of predetermined manners. The following description of the present invention, defines the reflective optics associated with the macroscopic optical system as having a vertical or horizontal orientation, for ease of understanding. However, it is to be readily understood that this type of definition of the orientation of the reflective optics associated with the macroscopic optical system is not limiting, since a rotation of the grid pattern results in reflective optics being oriented in a direction other than horizontal or vertical.

Each embodiment of the macroscopic optical system comprises a plurality of horizontal reflectors or reflective optics that enable the preferential redirection of illumination into the desired upper portion of the hemispherical luminous intensity distribution of the light emitting devices. In this manner an elevated amount of the illumination provided by the finite number of light emitting devices within the array can be used to create the desired illumination effect.

Figure 3:
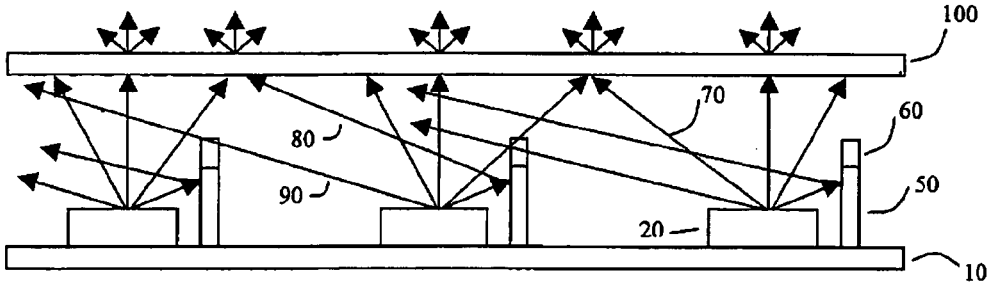
FIG. 3 illustrates a ray diagram and the associated vertical cross sectional view of a configuration including a macroscopic optical system and a microscopic optical system used together to manipulate illumination created by a plurality of light emitting devices, according to one embodiment of the present invention.
Figure 4:
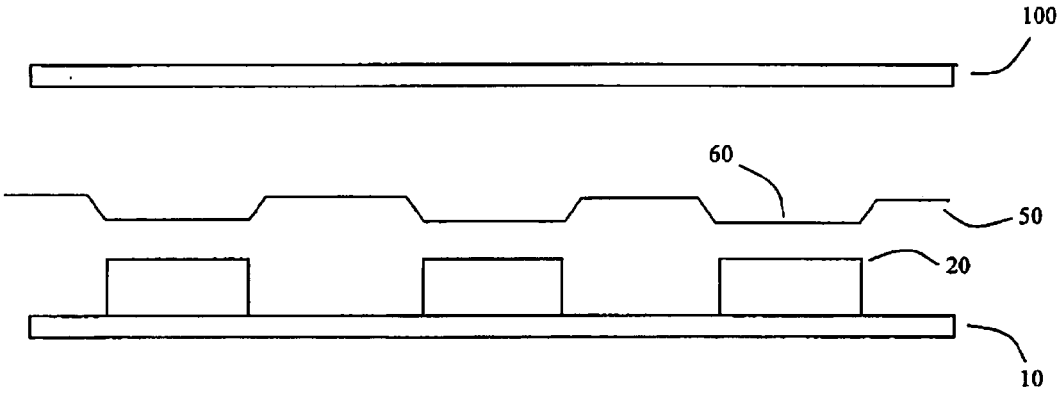
FIG. 4 illustrates a horizontal cross sectional view of the configuration including a macroscopic optical system and a microscopic optical system used together to manipulate illumination created by a plurality of light emitting devices, according to the embodiment illustrated in FIG. 3.

In one embodiment of the present invention the shape, placement and design of the reflective optics within the macroscopic optical system can enable a predominantly horizontal type of spread of the illumination created by the light emitting devices. In this embodiment of the invention, planar horizontal reflective optics are provided adjacent to the 1 or more light emitting devices in a particular row of the array. FIG. 3 and FIG. 4 illustrate a vertical cross section and horizontal cross section of the optical system according to this embodiment, respectively. While these figures illustrate a planar array of light emitting devices, for example 9 in total, the array can equally be linear in design and the macroscopic optical system would be designed to suit this shape of array.

Having regard to FIGS. 3 and 4, the horizontal reflective optics 50, provide a moderate off-axis distribution of the illumination with a wide beam spread in the vertical direction. The horizontal reflective optics include a slot 60 in the upper edge, wherein this slot allows illumination to propagate unimpeded into the desired upper portion of the hemispherical luminous intensity distribution of the light emitting devices. As illustrated in FIG. 3, there are essentially three forms of light rays, namely an unobstructed ray 70, a reflected ray, 80 and an unobstructed slot ray 90 that together form the illumination that subsequently interacts with the microscopic optic system 100.

The slot 60 in the horizontal reflective optics of this embodiment can be designed having a number of different shapes, widths and depths, wherein these features of the slot are determined based on the luminous intensity distribution and luminous area of the light emitting devices and the packaging thereof. The packaging of the light emitting devices can include refractive optics that are integral to the light emitting device itself, thereby varying the packaging associated with a light emitting device will alter the dispersion of the illumination created thereby. In order to determine the optimum geometrical characteristics of the slot, computer ray tracing techniques can be used, wherein this technique can take into account the desired illumination effect together with the illumination characteristics of a particular type of light emitting device.

Figure 5:
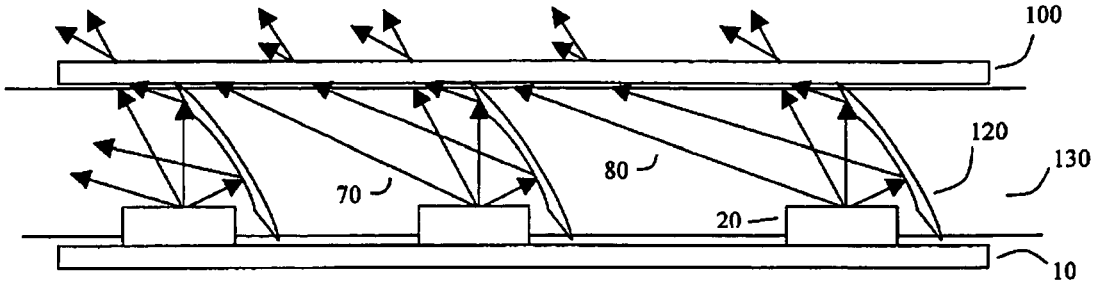
FIG. 5 illustrates a ray diagram and the associated vertical cross sectional view of a configuration including a macroscopic optical system and a microscopic optical system used together to manipulate illumination created by a plurality of light emitting devices, according to one embodiment of the present invention.
Figure 6:
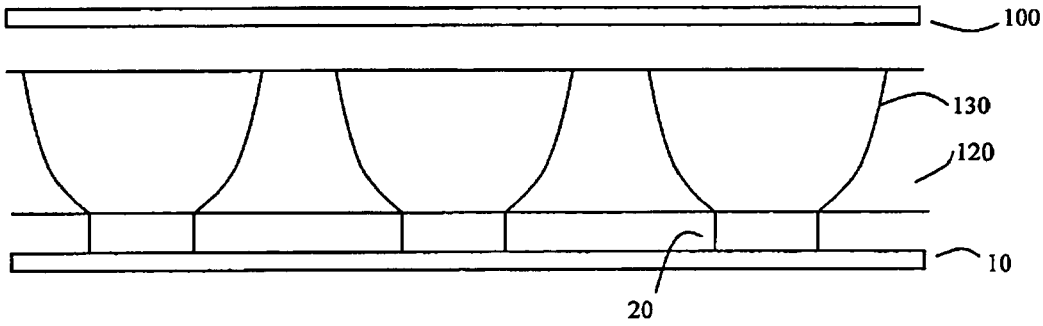
FIG. 6 illustrates a horizontal cross sectional view of the configuration including a macroscopic optical system and a microscopic optical system used together to manipulate illumination created by a plurality of light emitting devices, according to the embodiment illustrated in FIG. 5.

In another embodiment of the present invention the shape, placement and design of the reflective optics within the macroscopic optical system can enable a predominantly vertical type of spread of the illumination created by the light emitting devices. In this embodiment of the invention, linear, tilted and curved horizontal reflective optics are provided adjacent to the 1 or more light emitting devices in a particular row of the array. In addition, curved vertical reflective optics are provided adjacent to either side of the 1 or more light emitting devices in a particular column of the array which together form a trough surrounding the light emitting device in the vertical direction. FIG. 5 and FIG. 6 illustrate a vertical cross section and horizontal cross section of the optical system according to this embodiment, respectively. While these figures illustrate a planar array of light emitting devices, the array can equally be linear in design and as such the macroscopic optical system would be designed to suit this type of array.

Having specific regard to FIGS. 5 and 6, the tilted and curved horizontal reflective optics 120 provide strong off-axis distribution of illumination and further producing a narrow beam spread in the vertical direction. Additionally, the curved vertical reflective optics 130 on either side of a particular light emitting device form a trough and provide a narrow horizontal beam spread of the illumination. As an example, this form of narrow horizontal beam spread can be useful in wall illumination scenarios. As illustrated in FIG. 5, there are essentially two forms of light rays, namely an unobstructed ray 70 and a reflected ray, 80 that together form the illumination that subsequently interacts with the microscopic optic system 100.

In one embodiment of the invention, the vertical reflective optics 130 are shaped such that they create a parabolic trough that surrounds a column of light emitting devices as illustrated in FIG. 6. This form of vertical reflective optics provides a means for limiting the horizontal spread of illumination. In this manner a greater percentage of the illumination created by the finite number of light emitting devices can be directed towards the microscopic optical system.

Additionally, the horizontal reflective optics 120 are shaped as an off-axis parabola as illustrated in FIG. 5, thereby directing the illumination created by the light emitting devices in a more vertical direction as indicated by the ray traces 80. According to one embodiment, the vertical and horizontal reflective optics can be shaped such that they form a compound parabolic concentrator as described by Welford et al, in High Collection Nonimaging Optics, San Francisco, Academic Press, 1980. In addition, small modifications in the curvature, tilt angle, and position of the horizontal reflectors, in relation to the light emitting devices, can alter the vertical distribution of the illumination emitted by the light emitting devices, thereby enabling one to accommodate specific luminous intensity distribution requirements.

The packaging of the light emitting devices can include refractive optics that are integral to the light emitting device itself, thereby varying the packaging associated with a light emitting device will alter the dispersion of the illumination created thereby. In order to determine the optimum geometrical characteristics of the slot, computer ray tracing techniques can be used, wherein this technique can take into account the desired illumination effect together with the illumination characteristics of a particular type of light emitting device.

In one embodiment of the invention, the reflective optics of the macroscopic optical system are fabricated from specular aluminium, a metallised plastic or other form of stiff reflective material as would be readily understood by a worker skilled in the art. As an example, reflective optics fabricated from a specular aluminium material can provide approximately 95% efficiency of illumination redirection.

Microscopic Optical System

Subsequent to interaction with the macroscopic optical system, the illumination is manipulated by a microscopic optical system that provides for the diffusion of the illumination in the desired manner while retaining control of the desired angular distribution created by the macroscopic optical system.

In one embodiment of the invention, the microscopic optical system preferentially diffuses light in the horizontal direction, thereby providing a means for blending illumination emitted from columns of light emitting devices. This feature can be advantageous when the illumination from various columns of light emitting devices are of varying wavelengths, for example, red, green, and blue LEDs. In addition, the horizontal diffusion provided by the microscopic optical system can enable the reduction of the appearance of high brightness or illumination "hot spots" which can result from the illumination of an area using point light sources like light emitting devices. For example, the microscopic optical system can be a holographic diffuser with a linear or elliptical distribution, a mechanically-produced plastic diffuser, a lenticular array or any other form of diffuser having horizontal diffusion characteristics as would be readily understood by a worker skilled in the art. As examples, a suitable holographic diffuser is called a Light Shaping Diffuser™ which is produced by Physical Optics Corporation, Torrance, Calif., a suitable mechanically-produced plastic diffuser is a Rosco Tough Silk™, produced by Rosco Laboratories Inc., Stamford, Conn.), and a suitable lenticular array is produced by Fresnel Technologies Inc., Fort Worth, Tex. While these are examples of suitable microscopic optical systems enabling horizontal diffusion of the illumination, a plurality of other devices having similar characteristics to those defined would be suitable for integration into the illumination optical system according to the present invention.

In another embodiment of the invention, the microscopic optical system diffuses light evenly in all directions, wherein diffusers such as a holographic diffuser with circular distributions, frosted or sandblasted glass, plastic diffuser, lenslet array or other form of diffuser having this type of diffusion characteristic, as would be readily understood by a worker skilled in the art.

FIGS. 3 and 5 illustrate ray diagrams representing the illumination subsequent to interaction with a microscopic optical system in the form of a diffuser 100 according to different embodiments of the present invention. As an example, with reference to FIG. 5, it can be seen that the microscopic optical system, in the form of a diffuser 100, is designed to retain the desired angular distribution of the illumination previously created by the macroscopic optical system.

Figure 7:
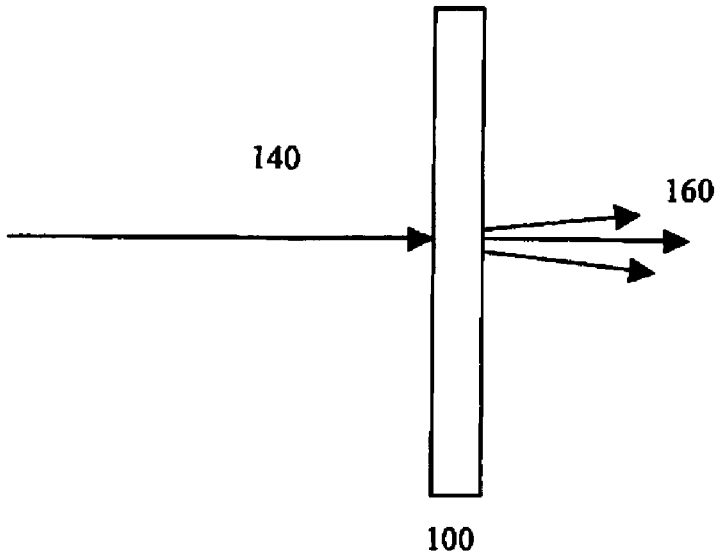
FIG. 7 illustrates a ray diagram indicating light interaction with a macroscopic optical system according to one embodiment of the present invention.
Figure 8:
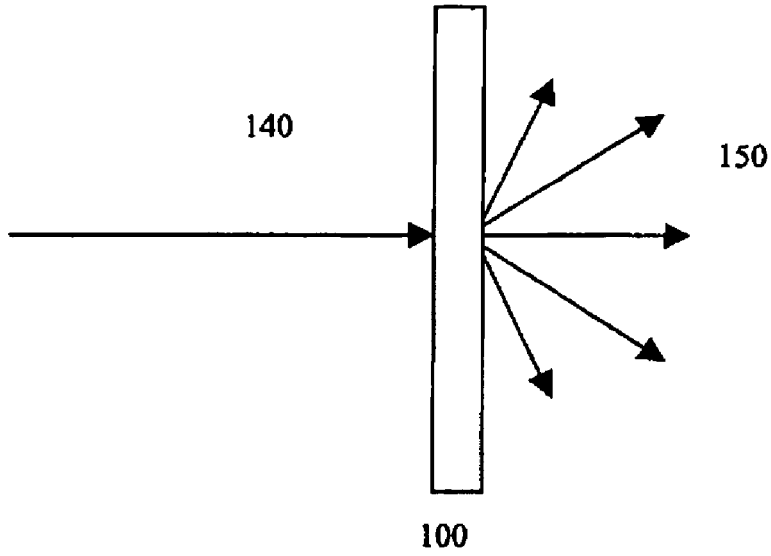
FIG. 8 illustrates a ray diagram indicating light interaction with a macroscopic optical system according to another embodiment of the present invention.

FIG. 7 illustrates the diffusion of an incident ray 140 by a diffuser 100, wherein the diffused light 160 is manipulated in a predominantly horizontal manner. Additionally, FIG. 8 illustrates an incident ray being manipulated such that the illumination or diffused light 150, is diffused in a predominantly vertical manner.

In one embodiment, holographic diffusers are used as the microscopic optical system as they typically have high transmittance of approximately 80 to 90%, which is more efficient than frosted glass or plastic diffusers which have a transmittance of approximately 30 to 70%.

Light Emitting Devices

The present invention can be associated with a plurality of light emitting devices that are arranged in an array. These light emitting devices can produce any number of illumination wavelengths and can be arranged in a variety of orders or patterns within the array. For example, the plurality of light emitting devices are capable of producing wavelengths of illumination including red, green and blue, for example, thereby upon the blending thereof can enable almost any colour of illumination to be created. In addition, one or more amber light emitting devices can be integrated into the array in order to enhance the colour gamut together with colour rendering properties of the array.

In one embodiment of the invention, the light emitting devices are manufactured on a printed circuit board. Light emitting devices of different colours require different drive voltages in addition to having varying illumination colour creation even within the same colour band. As such, the lighting industry performs an organisation routine, typically referred to as binning, in order to ensure a uniform illumination colour is being produced by a collection of light emitting devices. As such, manufacturers typically offer pre-assembled arrays of single colour light emitting devices with matched colours. These forms of arrays can readily be used in the illumination optical system according to the present invention. Optionally, a two dimensional printed circuit board can be used.

EXAMPLES

Example 1

Optical System for Predominantly Horizontal Distribution of Illumination

Figure 9:
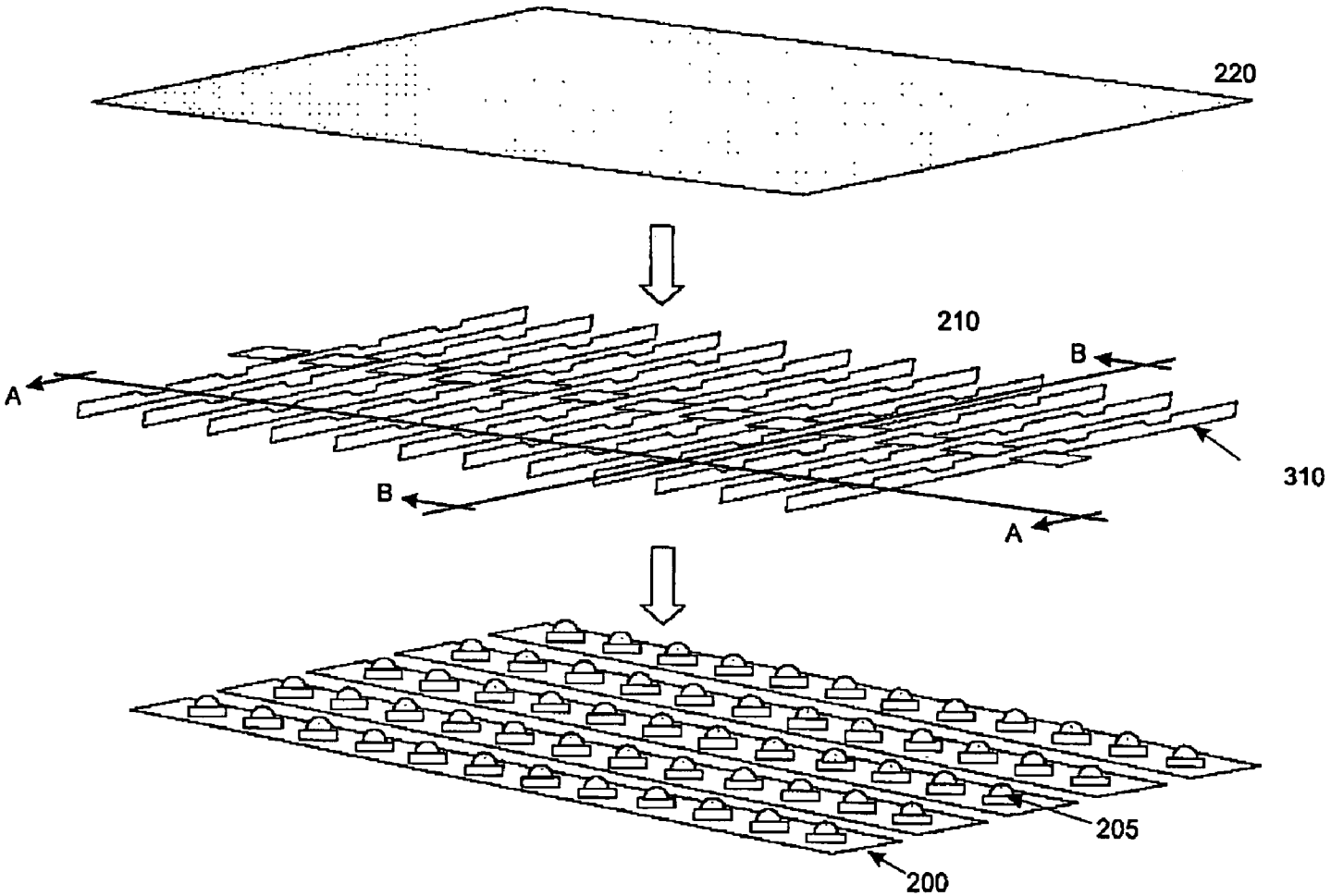
FIG. 9 illustrates an array of light emitting devices having a macroscopic optical system and microscopic optical system designed for manipulating light in a predominantly horizontal direction, according to one embodiment of the present invention.
Figure 10:
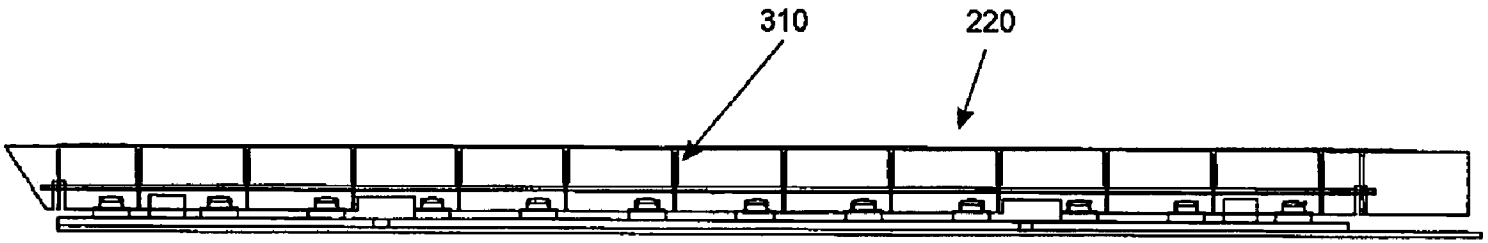
FIG. 10 is a cross sectional view of the macroscopic optical system illustrated in FIG. 9, as taken along A—A.
Figure 11:
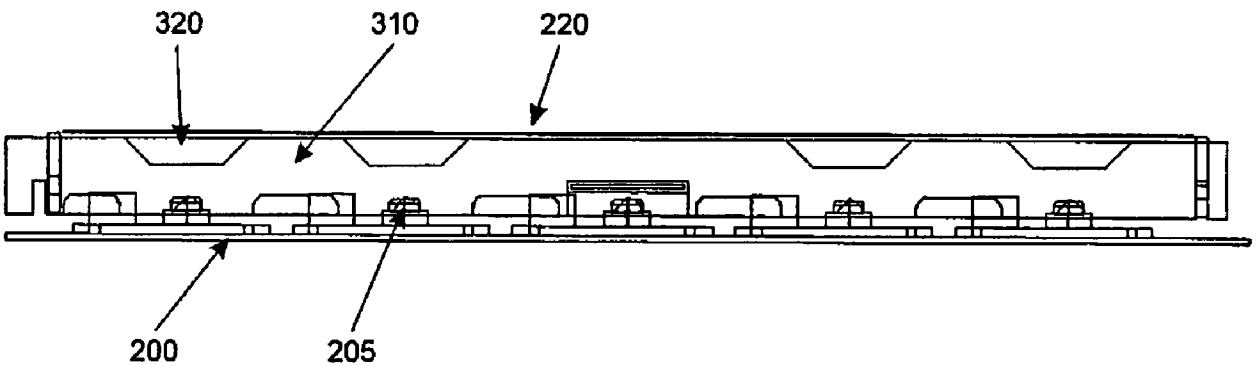
FIG. 11 is a cross sectional view of the macroscopic optical system illustrated in FIG. 9, as taken along B—B.

In one embodiment of the present invention, the illumination optical system is designed for a predominantly horizontal distribution of the illumination created by the light emitting devices. FIG. 9 illustrates three components of an optical system meeting this criterion, wherein the optical system comprises a two dimension array of light emitting devices 205 on collection of aligned linear printed circuit boards, 200, a macroscopic optical system 210 incorporating horizontal reflective optics 310 and a microscopic optical system 220 in the form of a diffuser. Cross sections A—A and B—B of the illumination optical system are illustrated in FIGS. 10 and 11, respectively. While the cross section is identified on the macroscopic optical system, the cross section illustrates a cross section of the three components together.

The macroscopic optical system that includes a plurality of horizontal planar reflective optics aligned with the rows of light emitting devices provides a moderate off-axis distribution of the illumination, further including a wide beam spread in the vertical direction. With regard to FIG. 11, the horizontal reflective optics 310 include a trapezoidal slot 320 centred on each light emitting device, wherein this form of the slot provides a means for allowing emitted light to propagate unimpeded into the desired upper portion of the hemispherical luminous intensity distribution of light emitting devices. Upon interaction with the macroscopic optical system the illumination is diffused by the microscopic optical system 220, providing a wide horizontal beam spread which can be applicable for surface illumination applications.

Figure 12:
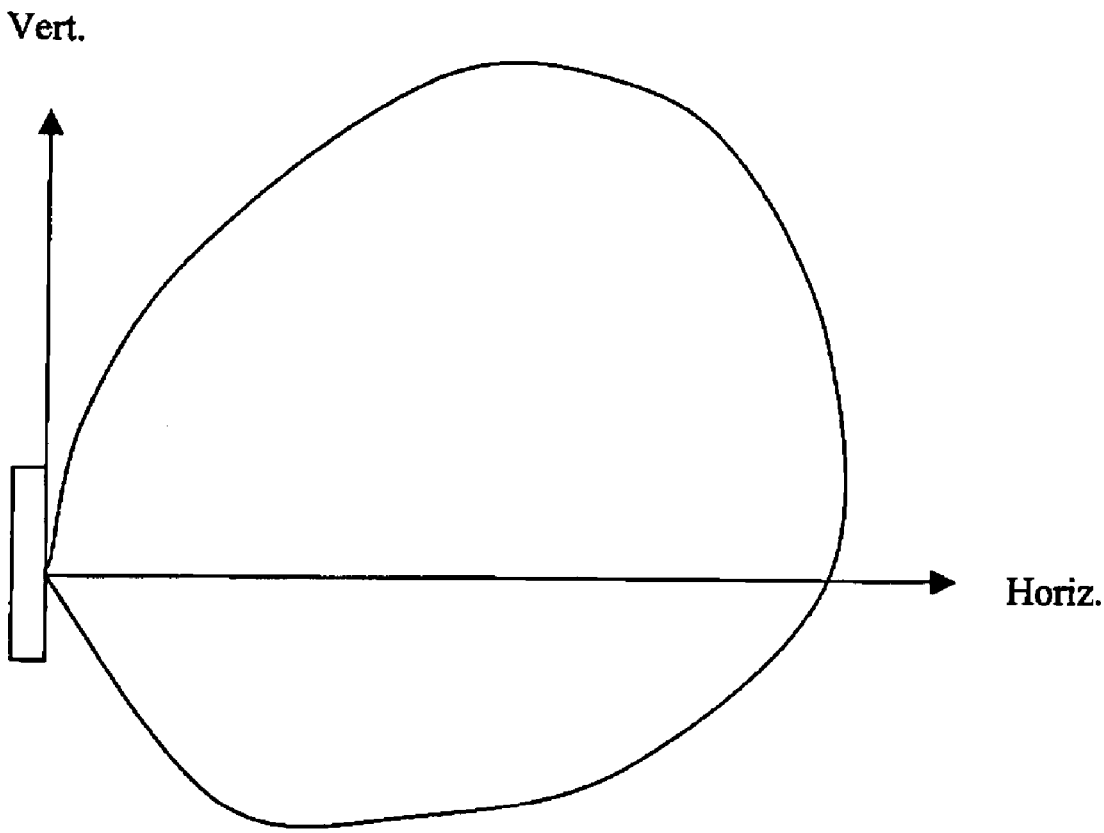
FIG. 12 is a candela distribution of illumination created by a device having the elements as illustrated in FIG. 9.

FIG. 12 illustrates the luminous distribution of an illumination system designed in this manner.

Example 2

Optical System for Predominantly Vertical Distribution of Illumination

Figure 13:
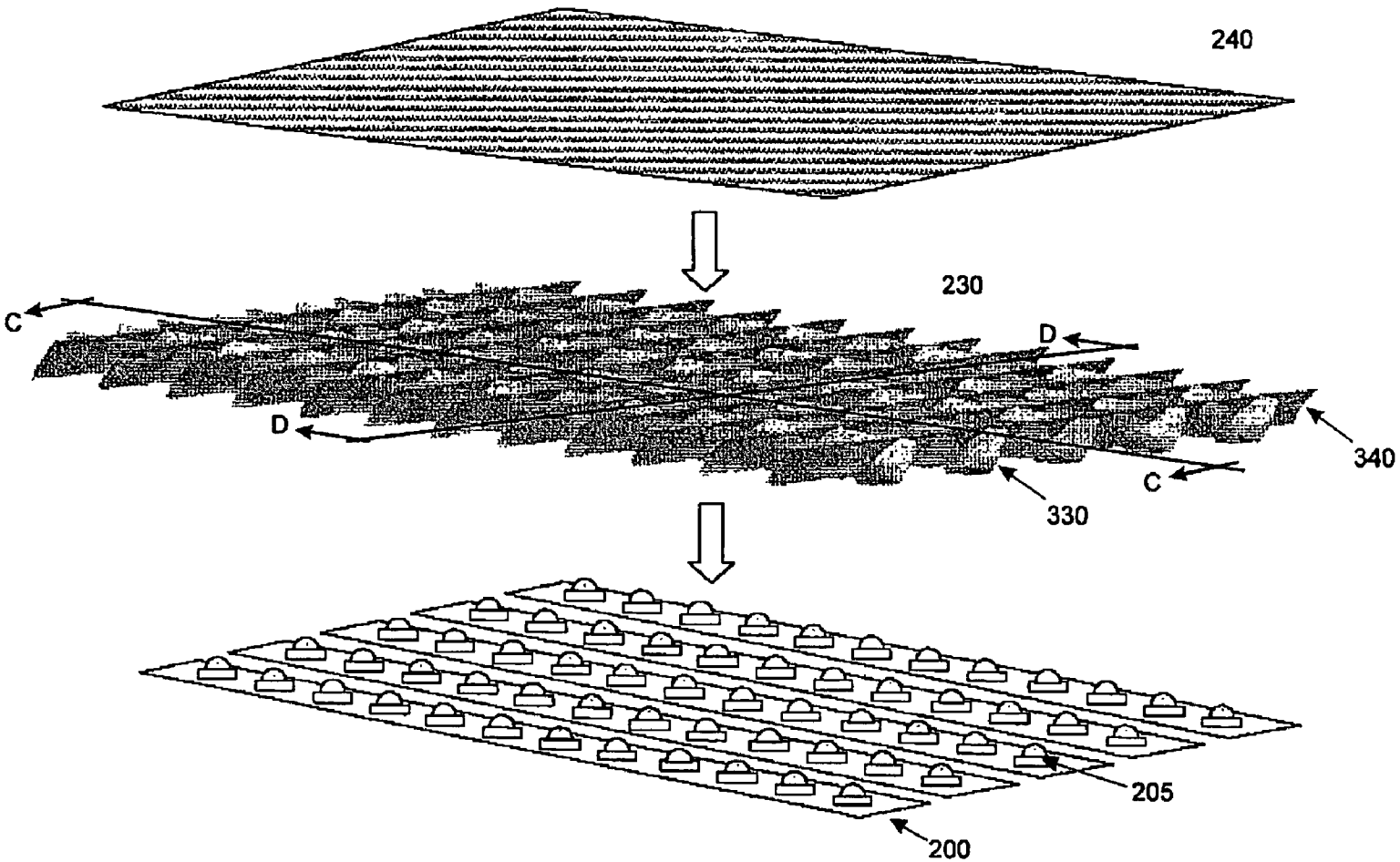
FIG. 13 illustrates an array of light emitting devices having a macroscopic optical system and microscopic optical system designed for manipulating light in a predominantly vertical direction, according to one embodiment of the present invention.
Figure 14:
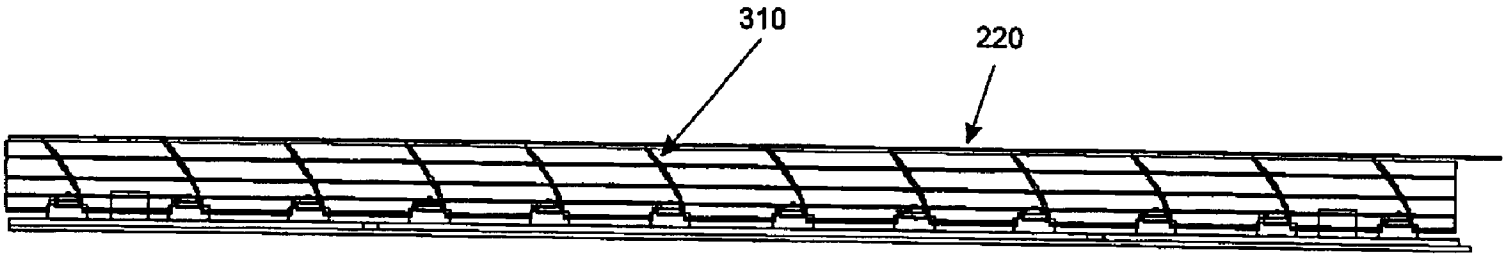
FIG. 14 is a cross sectional view of the macroscopic optical system illustrated in FIG. 13, as taken along C—C.
Figure 15:
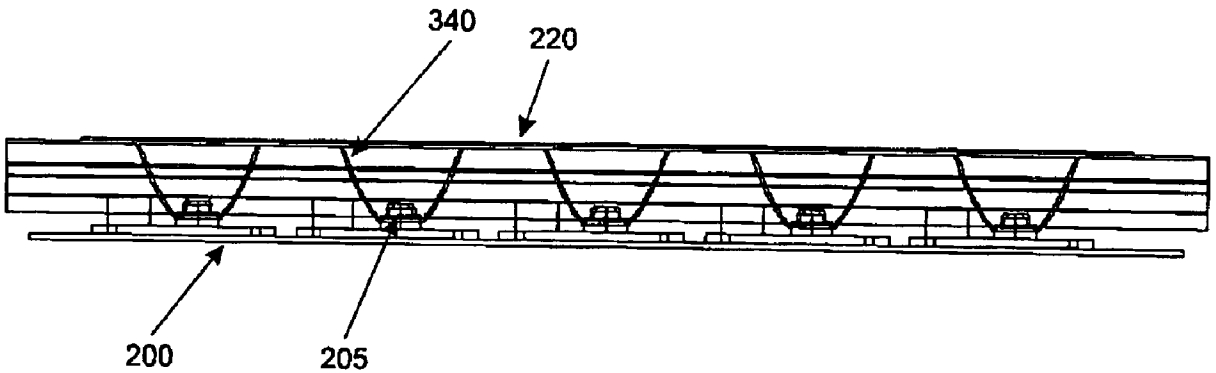
FIG. 15 is a cross sectional view of the macroscopic optical system illustrated in FIG. 13, as taken along D—D.

In one embodiment of the present invention, the illumination optical system is designed for a predominantly vertical distribution of the illumination created by the light emitting devices. FIG. 13 illustrates three components of an optical system meeting this criteria, wherein the optical system comprises a two dimension array of light emitting devices 205 on collection of aligned linear printed circuit boards, 200, a macroscopic optical system 230 incorporating tilted and curved horizontal reflective optics 340 and vertical parabolic trough reflective optics 330, together with a microscopic optical system 240 in the form of a diffuser. Cross sections C—C and D—D of the illumination optical system are illustrated in FIGS. 14 and 15, respectively. While the cross section is identified on the macroscopic optical system, the cross section illustrates a cross section of the three components together.

The macroscopic optical system that includes a plurality of horizontal reflective optics 340 that are tilted and curved in order to provide strong off-axis distribution of the illumination, while having a narrow beam spread in the vertical direction. The macroscopic optical system further comprises a plurality of vertical reflective optics 330 that are in the form of a parabolic trough, thereby providing a means for minimising the horizontal spread of the illumination. Upon interaction with the macroscopic optical system the illumination is diffused by the microscopic optical system 240 in the form of a diffuser that provides a means retaining the desired angular distribution of the illumination created by the macroscopic optical system.

Figure 16:
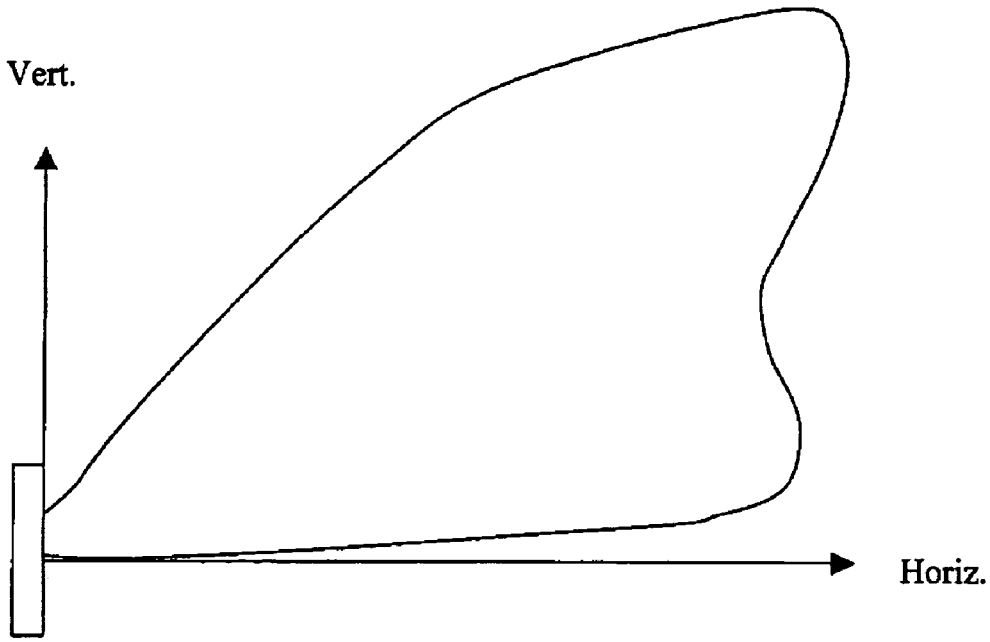
FIG. 16 is a candela distribution of illumination created by a device having the elements as illustrated in FIG. 13.

FIG. 16 illustrates the luminous distribution of an illumination system designed in this manner.

The embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for manipulating illumination created by an array of light emitting devices, said system comprising:

a) a plurality of light emitting devices spatially arranged in an array, said array separated into one or more sections, wherein each section of the array includes light emitting devices capable of creating illumination having a predetermined wavelength range;

b) a macroscopic optical system proximate to the plurality of light emitting devices, said macroscopic optical system enabling redirection of the illumination created by the plurality of light emitting devices, the macroscopic optical system providing a means for creating an off-axis distribution of the illumination; and c) a microscopic optical system for diffusing the illumination created by the plurality of light emitting devices subsequent to the redirection by the macroscopic optical system, the microscopic optical system configured to retain the off-axis distribution of the illumination; thereby providing a desired level of blending of the predetermined wavelengths ranges.

2. The system for manipulating illumination according to claim 1, wherein the macroscopic optical system includes at least one horizontal reflector.

3. The system for manipulating illumination according to claim 2, wherein the horizontal reflector is planar.

4. The system for manipulating illumination according to claim 3, wherein the horizontal reflector has a top and a bottom and at least one slot is formed in the top, wherein the slot is formed adjacent to one of the light emitting devices.

5. The system for manipulating illumination according to claim 4, wherein the slot is a trapezoidal shape.

6. The system for manipulating illumination according to claim 2, wherein the horizontal reflector is a linear reflector that is tilted and curved.

7. The system for manipulating illumination according to claim 6, wherein the horizontal reflector is a parabolic shape.

8. The system for manipulating illumination according to claim 1, wherein the macroscopic optical system includes at least one vertical trough reflector.

9. The system for manipulating illumination according to claim 8, wherein the vertical trough reflector is a parabolic shape.

10. The system for manipulating illumination according to claim 1, wherein the macroscopic optical system includes at least one vertical parabolic trough reflector and at least one horizontal linear tilted parabolic reflector.

11. The system for manipulating illumination according to claim 1, wherein the microscopic optical system is a diffuser that diffuses the illumination in a horizontal direction.

12. The system for manipulating illumination according to claim 11, wherein the microscopic optical system is selected from the group comprising a holographic diffuser having a linear or elliptical distribution, a mechanically produced plastic diffuser and a lenticular array.

13. The system for manipulating illumination according to claim 1, wherein the microscopic optical system is a diffuser that diffuses the illumination evenly in all directions.

14. The system for manipulating illumination according to claim 13, wherein the microscopic optical system is selected from the group comprising a holographic diffuser having a circular distribution, a frosted or sandblasted glass diffuser, a plastic diffuser and a lenslet array.

15. A method for manipulating illumination created by an array of light emitting devices, said method comprising the steps of:

a) redirecting the illumination created by the array of light emitting devices using a macroscopic optical system, the macroscopic optical system creating redirected illumination having an off-axis distribution;

b) diffusing the redirected illumination using a microscopic optical system thereby blending the redirected illumination to create a desired illumination effect, wherein diffusing the redirected illumination is performed to retain the off-axis distribution of the redirected illumination.

16. The method for manipulating illumination according to claim 15, wherein each light emitting device has a hemispherical luminous intensity distribution and wherein the step of redirecting the illumination results in the illumination being redirected into the upper portion of the hemispherical luminous intensity distribution.

17. The method for manipulating illumination according to claim 15, wherein the macroscopic optical system provides a means for redirecting the illumination in a predominantly vertical direction and the macroscopic optical system includes at least one vertical parabolic trough reflector and at least one horizontal linear tilted parabolic reflector and said horizontal reflector providing vertical redirection of the illumination.

18. The method for manipulating illumination according to claim 15, wherein the macroscopic optical system provides a means for redirecting the illumination in a predominantly horizontal direction and the macroscopic optical system includes at least one horizontal planar reflector and said horizontal reflector having a top and bottom wherein a slot is formed in the top of the horizontal reflector adjacent to at least one of the light emitting devices.

19. The method for manipulating illumination according to claim 18, wherein the slot has a trapezoidal shape.

* * * * *